US008675880B2

(12) United States Patent
De Bruijn et al.

(10) Patent No.: US 8,675,880 B2
(45) Date of Patent: Mar. 18, 2014

(54) DEVICE FOR AND A METHOD OF PROCESSING DATA

(75) Inventors: Werner Paulus Josephus De Bruijn, Eindhoven (NL); Daniel Willem Elisabeth Schobben, Eindhoven (NL); Willem Franciscus Johannes Hoogenstraaten, Eindhoven (NL); Ronaldus Maria Aarts, Eindhoven (NL); Johannes Hermannus Streng, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 1106 days.

(21) Appl. No.: 12/294,521

(22) PCT Filed: Mar. 22, 2007

(86) PCT No.: PCT/IB2007/051004

§ 371 (c)(1),
(2), (4) Date: Sep. 25, 2008

(87) PCT Pub. No.: WO2007/113718

PCT Pub. Date: Oct. 11, 2007

(65) Prior Publication Data

US 2010/0226499 A1 Sep. 9, 2010

(30) Foreign Application Priority Data

Mar. 31, 2006 (EP) ..... 06112067

(51) Int. Cl.
*H04R 5/00* (2006.01)

(52) U.S. Cl.
USPC ..... 381/17; 381/18; 381/23

(58) Field of Classification Search
USPC ..... 381/17, 18, 23
See application file for complete search history.

(56) References Cited

U.S. PATENT DOCUMENTS

| | | | | |
|---|---|---|---|---|
| 7,134,130 | B1 * | 11/2006 | Thomas | 725/25 |
| 2003/0081115 | A1 * | 5/2003 | Curry et al. | 348/14.12 |
| 2004/0196405 | A1 | 10/2004 | Spinelli | |
| 2005/0041530 | A1 | 2/2005 | Goudie | |
| 2005/0220311 | A1 | 10/2005 | Sun | |
| 2006/0012720 | A1 * | 1/2006 | Ding | 348/738 |
| 2006/0262012 | A1 * | 11/2006 | Nishikata et al. | 342/357.11 |

FOREIGN PATENT DOCUMENTS

| | | | |
|---|---|---|---|
| GB | 2228324 | A1 | 8/1990 |
| GB | 2418332 | A1 | 3/2006 |
| JP | 04351197 | A | 12/1992 |
| JP | 11027604 | A | 1/1999 |
| JP | 2005191851 | A | 7/2005 |

(Continued)

OTHER PUBLICATIONS

"Optimization Toolbox User's Guide", Matlab, Mathworks, R2012b.

(Continued)

*Primary Examiner* — Lynne Gurley
*Assistant Examiner* — Vernon P Webb

(57) ABSTRACT

A device (100) for processing data, the device (100) comprising a detection unit (110) adapted for detecting individual reproduction modes indicative of a manner of reproducing the data separately for each of a plurality of human users, and a processing unit (120) adapted for processing the data to thereby generate reproducible data separately for each of the plurality of human users in accordance with the detected individual reproduction modes.

25 Claims, 4 Drawing Sheets

(56) References Cited

FOREIGN PATENT DOCUMENTS

| | | | |
|---|---|---|---|
| JP | 2005197896 | A | 7/2005 |
| WO | 0241664 | A2 | 5/2002 |
| WO | 02078388 | A2 | 10/2002 |
| WO | 2004075601 | A1 | 9/2004 |
| WO | 2005086526 | A1 | 9/2005 |

OTHER PUBLICATIONS

Van Beuningen et al, "Optimizing Directivity Properties of DSP Controlled Loudspeaker Arrays", Duran Audio, 2000, Pages.

* cited by examiner

DEVICE FOR AND A METHOD OF PROCESSING DATA

FIELD OF THE INVENTION

The invention relates to a device for processing data.

The invention further relates to a method of processing data.

Moreover, the invention relates to a program element.

Further, the invention relates to a computer-readable medium.

BACKGROUND OF THE INVENTION

Audio playback devices become more and more important. Particularly, an increasing number of users buy audio players and other entertainment equipment for use at home.

WO 2002/078388 discloses a method and an apparatus for taking an input signal, replicating it a number of times and modifying each of the replicas before routing them to respective output transducers such that a desired sound field is created. This sound field may comprise a directed beam, focused beam or a simulated origin. In a first aspect, delays are added to sound channels to remove the effects of different traveling distances. In a second aspect, a delay is added to a video signal to account for the delays added to the sound channels. In a third aspect, different window functions are applied to each channel to give improved flexibility of use. In a fourth aspect, a smaller extent of transducers is used to output high frequencies than are used to output low frequencies. An array having a larger density of transducers near the centre is also provided. In a fifth aspect, a line of elongate transducers is provided to give good directivity in a plane. In a sixth aspect, sound beams are focused in front or behind surfaces to give different beam widths and simulated origins. In a seventh aspect, a camera is used to indicate where sound is directed.

WO 2002/041664 discloses an audio generating system that outputs audio through two or more speakers. The audio output of each of the two or more speakers is adjustable based upon the position of a user with respect to the location of the two or more speakers. The system includes at least one image capturing device (such as a video camera) that is trainable on a listening region and coupled to a processing section having image recognition software. The processing section uses the image recognition software to identify the user in an image generated by the image capturing device. The processing section also has software that generates at least one measurement of the position of the user based upon the position of the user in the image.

However, these systems may be inconvenient when used by multiple human users.

OBJECT AND SUMMARY OF THE INVENTION

It is an object of the invention to provide a device enabling a user-friendly operation even when used by multiple human users at the same time.

In order to achieve the object defined above, a device for processing data, a method of processing data, a program element, and a computer-readable medium according to the independent claims are provided.

According to an exemplary embodiment of the invention, a device for processing data is provided, the device comprising a detection unit adapted for detecting individual reproduction modes indicative of a manner of reproducing the data separately for each of a plurality of human users, and a processing unit adapted for processing the data to thereby generate reproducible data separately for each of the plurality of human users in accordance with the detected individual reproduction modes.

According to another exemplary embodiment of the invention, a method of processing data is provided, the method comprising detecting individual reproduction modes indicative of a manner of reproducing the data separately for each of a plurality of human users, and processing the data to thereby generate reproducible data separately for each of the plurality of human users in accordance with the detected individual reproduction modes.

According to still another exemplary embodiment of the invention, a program element is provided, which, when being executed by a processor, is adapted to control or carry out a method of processing data having the above mentioned features.

According to yet another exemplary embodiment of the invention, a computer-readable medium is provided, in which a computer program is stored which, when being executed by a processor, is adapted to control or carry out a method of processing data having the above mentioned features.

The data processing according to embodiments of the invention can be realized by a computer program, which is by software, or by using one or more special electronic optimization circuits, that is in hardware, or in hybrid form, that is by means of software components and hardware components.

According to an exemplary embodiment of the invention, it may be made possible that two or more humans simultaneously perceive media content to be played back, based on input or automatically detected different operation modes specified in accordance with the personal requirements of each individual user, and without the need to form shielded "perception spaces", that is to say without the need of implementing earpieces, headphones or the like. For example, it is possible that a loudspeaker array is provided which adjusts the amplitude and intensity of audio to be played back simultaneously for a plurality of different users which desire to enjoy the reproduced audio according to varying reproduction modes. This may include a directed reproduction of the content, so that a spatial dependence of emitted audio content may be achieved. The data content to be reproduced in a user-specific manner may be different or may be equal for different users.

According to an exemplary embodiment of the invention, individual sound levels may be generated individually for different people listening to the same audio stream. Individual listeners may have individual remote controls with which they can select their own preferred sound level. Additionally or alternatively, one or more cameras may be used to detect and track the positions of the individual listeners, and visual recognition software may be used to identify the individual listeners from a set of known persons. Additionally or alternatively, the position/direction of a single listener may be identified by means of a tag (for instance an RFID tag), worn by or attached to the person or persons, and the level of the sound may then be adapted in that person's directions according to a stored profile.

There are many situations in which people want to enjoy an audio (or audiovisual) experience in a room in which other people are present. Sometimes, the intention is to enjoy the audio experience together, like when watching TV or a movie in the living room together with family or friends. In another scenario, one person might be watching TV, while another person is reading a book. In both scenarios, the different people in the room can have different preferences for the sound levels of the reproduced audio. In the second case, the person reading the book does not want to be disturbed by too loud sound from the TV. But also in the first case, there are various reasons why the people watching TV or a movie together may have different preferences for the level of the reproduced sound. For example, one person may just enjoy watching movies very loudly, while one of the other persons prefers a more modest level. Personal volume adjustment may then be performed according to an exemplary embodiment. Another possibility is that one of the persons has a hearing problem and so requires a higher sound level than the other persons to be able to understand the reproduced speech. Additionally, a personal preference for a different sound level can also be temporary, for instance when a person receives a phone call while watching a movie together with others.

In contrast to conventional audio setups, embodiments of the invention may make it possible to select not only a single, overall level for the reproduced sound, but a reproduction mode which is adjusted individually to the requirements of the individual user, and thus particularly different for different users.

Thus, according to an exemplary embodiment, a sound system is provided comprising means enabling selecting and generating individual sound levels for individual people listening to the same audio stream.

According to one exemplary embodiment, individual listeners may have individual remote control devices, with which they can select their own preferred sound level.

In another embodiment, one or more cameras are used to detect and track the positions of the individual listeners and visual recognitions of them may be used to identify the individual listeners from a set of preknown persons (for instance in accordance with prestored visual profiles for visual recognition of individuals). Additionally or alternatively, "prestored personal profiles" may be provided as some kind of "reproduction preference profiles" corresponding to a respective default reproduction mode of an individual.

In still another embodiment, the direction of a single listener may be identified by means of a tag, worn by or attached to the person, and the level of sound may be adapted in that person's direction according to a stored profile.

Thus, exemplary embodiments of the invention may make it possible to obtain an improved listening experience, provide individual people with individual sound levels, and this without a necessity of using headphones.

Exemplary fields of application of embodiments of the invention are home entertainment/cinema systems, flat TV applications, and car audio applications.

Thus, embodiments of the invention may solve the problem how to adjust the desired sound volumes for two or more persons simultaneously, for example in watching (and listening to) TV. An appropriate measure may be to reproduce the sound through a number of n (n>1) loudspeakers such that the sound is received by a number of m listeners with the desired strength. The weighting factor for each loudspeaker may be selected, for instance, through solving m equations with n unknowns, such that the loudness complies with the adjusted value for each person as much as possible (Multiple Personal Preference).

A simple implementation of an embodiment of the invention can be obtained with two loudspeakers in that volume and balance may be simultaneously adjusted such that the loudness can be individually set for the two listeners. If the listeners have a remote control provided with a microphone, the mechanism can be controlled fully automatically.

According to an exemplary embodiment, means are provided that enable selecting and generating individual sound levels for individual people listening to the same audio stream. Various methods and scenarios are possible for providing the system with the information which sound level is desired in which direction. Essentially, all the methods and scenarios result in a specification of the desired sound level as a function of direction or position (the so-called "target response"). A loudspeaker array combined with digital signal processing can be used to generate a sound field that has a sound level versus direction characteristic that corresponds to this target response.

With a conventional audio setup, in all the situations a level has to be chosen that is at best a compromise between the individual preferences, and the resulting sound level will be different from the preferred level (and may be even highly unpleasant) for one or more persons.

According to an exemplary embodiment, a much nicer effect may be achieved that all persons that are present in the room are able to select a personal level for the sound so that it suits their (possibly temporary) preference.

By using headphones, it is possible to select individual sound levels for individual persons, but in many situations this may be an unacceptable solution, especially when several people are watching the same program together. Thus, according to an exemplary embodiment of the invention, a system may be made available that is able to provide individual people with individual sound levels without using headphones.

According to an exemplary embodiment, a sound reproduction system is provided which is able to render sound for multiple listeners, wherein these listeners can control their own sound level ("volume"). Particularly, the users may have their own remote controls (RCs) to control their volume. The position of the listener may be automatically detected, for instance using a microphone in the remote control. Furthermore, a camera may detect and track the listeners' positions and identities, and the system may correct according to the hearing profiles of the individual listeners. One listener may wear a tag for finding her or his position automatically, in which the sound is adapted for her or his position and/or profile (for example "always a bit louder/weaker"). One or more loudspeaker arrays may be used to reproduce the sound.

Thus, a "personal volume"-like feature may be obtained, and a desired "volume versus angle" characteristic or target response may be obtained. With a single (or a plurality) of audio input channels, it may be possible to personalize the audio playback by controlling the directivity of the generated beams. This may allow personalizing the audio playback for multiple listeners. This allows providing individual volume control for multiple individual listeners listening to the same sound source (or listening to different sound sources). To achieve such a result, it is possible to use multiple loudspeakers. The required loudspeaker signals to obtain directivity may be determined. Furthermore, a desired target response may be set.

According to another exemplary embodiment of the invention, Automatic Level Control (ALC) may be performed for sound beaming of multiple different audio streams. The term "Automatic Level Control" may particularly denote a technology that automatically controls output powers to the speakers.

For at least two concurrent audio channels driving an array of loudspeakers, it may be made possible to ensure a channel separation of at least 11 dB at all times, the incoming streams may be passed through ALC circuits which make their level differences within threshold (performance headroom), based on the audio separation that may be obtained by the array. The reduction of the level difference between the input signals may be split into two stages, one consisting of a reduction of the dynamic range of the individual channels and one consisting of a reduction of the level difference between them, wherein both stages may work with different time constants. Furthermore, features of user controllable listening positions and the amount of reduction of the level between the input signals may be provided. Beyond this, features of the level separation between channels may be set automatically based on the content classification and frequency bandwidth application of Automatic Level Control (ALC). The term "frequency bandwidth application of ALC" may particularly denote that the control of the gain of the audio content may be performed independently for different frequency ranges of the audio content.

An array of loudspeakers may generate personal sound. In other words, for example sound of two input audio channels may be sent concurrently to individual directions, that is to say user listening positions. Conventionally, listening experience may be "clouded" due to annoying crosstalk from the undesired channels.

According to an exemplary embodiment of the invention, a sound reproduction system may be provided comprising means for providing personal sound to at least two users based on (at least two) input signals of different input audio channels, wherein the sound according to each input channel is transmitted to an individual target direction. An Automatic Level Control unit (ALC) may be provided for adapting the signal level of the different input signals, wherein a determining unit may be provided for determining a difference signal of the input signals. A control unit may be provided for controlling the signal levels based on comparing said difference signals in relation to a predetermined threshold value (Performance Headroom).

According to an exemplary embodiment, controlling of the signal levels is made dependent on audio separation that is achievable by said means for providing personal sound (that is to say a loudspeaker array). Parameters on audio separation may be known from simulations or based on known (measured in the lab) acoustical properties of the loudspeaker array. In another exemplary embodiment, measurements of room acoustics may be performed to get even more accurate parameters on audio separation, for this a microphone (or multiple microphones) might be advantageous to get information on the room environment.

According to another exemplary embodiment, a compressor unit may be provided for each input channel, which compressor unit may be adapted to reduce the dynamic range of the respective input signal before it is sent to the Automatic Level Control unit. This way, the risk of an occurrence of "pumping" artifacts may be reduced.

Therefore, a comfortable listening experience may be achieved without annoying crosstalk from an undesired channel.

According to an exemplary embodiment, a personal sound array with Automatic Level Control may be provided.

In order to achieve a comfortable listening experience when two people are listening to two concurrent audio streams, it has been found that typically a separation of at least 11 dB is required. Given the physical limitation on the array with respect to the number of drivers and the total array length that can be afforded/fit in a product such as a flat TV, it is typically possible to obtain a channel separation of about 15 dB for two seats spaced about 30° apart, relative to the centre of the array, which suffices if the two channels are equally loud. Typically, content from various channel resources have a different average loudness as well as large dynamic ranges. One channel can contain speech at a low volume, while the other contains a loud part in a movie. An advantageous feature of an exemplary embodiment of the invention is that Automatic Level Control (ALC) is used in conjunction with the personal sound array to guarantee an 11 dB channel separation at all times and for all configurations.

According to an exemplary embodiment, a general concept is generating multiple beams for multiple listeners, possibly each with an individual volume control. Particularly, personal sound and personal volume may be taken into account.

According to an exemplary embodiment, individual beams may represent different input signals, in which case it is desirable to reduce or minimize crosstalk from the other beams for each listener. In order to improve or optimize the situation for all listeners at the same time, an appropriate measure may be to reduce or minimize the level differences between the different input signals as much as possible so that all beams have the same relative volume, and advantage can be taken from the unavoidably limited direction performance of the array.

It might be inappropriate in such a scenario that the individual listeners are able to control the volume of the individual beam, since turning up the volume for one listener might deteriorate the effect for the other listeners (unless an array is available with such a good direction performance that the suppression of each beam in the directions of all other beams is almost perfect). To cover such a situation, ALC may be implemented to remove relative level differences between the individual channels.

However, in contrast to this, in a personal volume application, the situation is much less critical, because all listeners are listening to the same input signal. Therefore, in such a scenario it is no problem that each of the individual human beings enjoying the media content may adjust their individual playback parameters individually.

Such a personal volume approach may be based on the assumption that the directional performance of the array is sufficient to allow the freedom to manipulate the volume in individual directions independently.

According to another exemplary embodiment, different audio streams (for instance different TV channels) may be perceived by two different human users simultaneously, wherein in this case an individual adjustment of parameters like volume, etc. is only possible when an undesired crosstalk between those two channels may be avoided.

According to an exemplary embodiment of the invention, a sound reproduction system is provided which provides personal sound to at least two users and which reduces the level difference between the input signals using an Automatic Level Control system (ALC). The transducers may form a loudspeaker array. The amount of reduction of the level difference between the input signals may be related to the audio separation that is obtained by the array. The reduction of the level difference between the input signals may be split into two stages, one comprising a reduction of the dynamic range of the individual channels and one comprising a reduction of the level difference between them, both stages working with different time constants. The listening positions may be user-controllable. The amount of reduction of the level difference between the input signals may be user-controllable. The amount of reduction of the level difference between the input signals may depend on an automatic content classification. The ALC may work in frequency bands.

Next, further exemplary embodiments of the invention will be explained. In the following, further exemplary embodiments of the device for processing data will be explained. However, these embodiments also apply for the method of processing data, for the program element and for the computer-readable medium.

The device may comprise a reproduction unit adapted for reproducing the generated reproducible data separately for each of the plurality of human users. Such a reproduction unit may be an image reproduction unit, an audio data reproduction unit, a vibration unit, or any other unit for reproduction of a perceivable signal individually for a plurality of human users.

Particularly, the reproduction unit may be adapted for reproducing the generated reproducible data in at least one of the group consisting of a spatially selective manner, a spatially differentiated manner, and a directive manner. "Directive" may mean that sound is directed towards a certain direction. "Selective" and "differentiated" may mean more generally that the reproduction is different for different directions. A spatial dependence of the emission of the reproducible data may be brought in accordance with a current position of a corresponding user. For example, when the reproduction unit comprises a plurality of loudspeakers, the configuration of such loudspeakers may be such that they emit acoustic waves directed selectively in the direction of different users, so that an overlap of the individual loudspeaker signals generate acoustic patterns at the position of the individual users which are in accordance with the selected reproduction mode.

The reproduction unit may comprise a spatial arrangement of a plurality of loudspeakers. In such a scenario, different or varying audio reproduction modes may be realized for different users.

Particularly, the device may be adapted for processing data comprising at least one of the group consisting of audio data, video data, image data, and media data. Thus, content of different origins may be personalized so that, according to this exemplary embodiment, the same content is reproduced for all users, but with different reproduction parameters. Alternatively, it is also possible to simultaneously reproduce different content for different users, with identical or varying reproduction parameters.

The detection unit may comprise a plurality of remote control units, each of the plurality of remote control units being assigned to one of the plurality of human users and being adapted for detecting the individual reproduction modes. For example, each of the users of such a multi-user system may be equipped with an assigned remote control unit via which the user can provide the information which reproduction parameters she or he desires. The individual remote control units may be pre-individualized, for instance by assigning human user related data to the control units. By taking this measure, instructions may be input, for example that a particular member of the family has a hearing problem and usually requires a high volume reproduction of the audio data. It may also be personalized that a special user desires to have a very low image contrast value so that the image reproduction by such a device can be adjusted accordingly.

The detection unit may comprise a distance and/or direction measuring unit adapted for measuring the distance and/or direction between the device and each of the plurality of human users. Such a distance and/or direction measurement unit may for instance be a microphone integrated in the corresponding remote control units, so that an automatic acoustical-based distance measurement may be performed, and the corresponding distance or angular position information may then be used as a basis for adjusting the user specified operation mode. Particularly, a direction measuring unit may be provided for measuring the direction between a reference direction and a direction of each of the plurality of human users with respect to this reference direction.

According to another exemplary embodiment, the detection unit may comprise an image recognition unit adapted for acquiring an image of each of the plurality of human users and adapted for recognizing each of the plurality of human users, thereby detecting the individual reproduction modes. For example, one or more cameras may capture (permanently or from time to time) images of the users. With an image recognition system, possibly combined with prestored personal data, may then automatically detect the present position and/or the present activity state of the respective user. For instance, the image recognition unit may detect that the person "Peter" presently reads a book and does not want to be disturbed by a too loud television signal. Based on this automatic image recognition, the reproduction parameters may be adjusted accordingly.

The detection unit may comprise a plurality of identification units, each of the plurality of identification units being assigned to one of the plurality of human users and being adapted for detecting the individual reproduction modes. For instance, the individual identification units may be RFID tags connected to or worn by the respective users. Based on such an information, it is possible to adjust the reproduction mode to prestored user preferences, in accordance with the identification encoded in the identification units.

Each of the individual reproduction modes may be indicative of at least one of the group consisting of an audio data reproduction loudness, an audio data reproduction frequency equalization, an image data reproduction brightness, an image data reproduction contrast, an image data reproduction color, and a data reproduction trick-play mode. For example, the amplitude and/or the frequency characteristics of a reproduced audio content item may be adjusted. It is also possible to adjust image properties like brightness, contrast and/or color. If desired by a special user, an image may be reproduced in black and white instead of in color. Trick-play modes like fast forward, fast reverse, slow forward, slow reverse, standstill may also be individually adjusted, for instance when a user desires to review a scene of a movie, whereas the other persons desire to go on watching the movie. In such a scenario, it might be desirable to provide individual displays for the individual users.

The processing unit may be adapted to generate the reproducible data in accordance with at least one of the group consisting of a detected position, a detected direction, a detected activity, and a detected human user-related property of each of the plurality of human users. For instance, the spatial orientation, an angular orientation position, a presently performed practice or task, or a property related to the respective user (for instance hearing problems) may be taken into account so as to adjust the reproducible data accordingly.

The processing unit may further be adapted to generate the reproducible data in accordance with an audio data level-versus-human user direction characteristic derived from the detected individual reproduction modes. Thus, the angular distribution of the emitted acoustic waves may be adjusted so as to consider the respective positions of the individual users.

The processing unit may be adapted to generate reproducible data separately for each of the plurality of human users based on data which differ for different ones of the plurality of human users. According to this embodiment, different users simultaneously perceive different audio items, for instance different audio pieces. In such a scenario, the processing may be performed in such a manner that disturbing crosstalk between these individual signals is suppressed, and care may be taken to keep the intensity of the background noise originating from content reproduced by another user such low that it is not disturbing for a user.

Particularly, in such a scenario, the processing unit may be adapted to generate the reproducible data implementing an Automatic Level Control (ALC) function. Such an Automatic Level Control may particularly be performed in such a manner so as to guarantee that an intensity separation for different ones of the plurality of human users is at least a predetermined threshold value. This threshold value may be 11 dB, which has been determined in experiments to be a sufficient value to allow a human listener to distinguish between the presently reproduced audio item and audio items simultaneously reproduced by other users, however emitted predominantly in other directions.

The predetermined threshold value may also be user-controllable. If a user is very sensitive, measures may be taken in accordance with the user-defined threshold value so as to reduce the disturbing influence of other user's audio reproduction.

The processing unit may be adapted to generate the reproducible data implementing a frequency-dependent Automatic Level Control. In other words, different frequency bands may be modified with an Automatic Level Control algorithm in a different manner, since the effect of crosstalk between the reproduced audio items and simultaneously reproduced audio items of other users may be frequency-dependent.

The apparatus may be a realized as a television device, a video recorder, a monitor, a gaming device, a laptop, an audio player, a DVD player, a CD player, a hard disk-based media player, an internet radio device, a public entertainment device, an MP3 player, a hi-fi system, a vehicle entertainment device, a car entertainment device, a medical communication system, a body-worn device, a speech communication device, a home cinema system, and/or a music hall system. A "car entertainment device" may be a hi-fi system for an automobile.

However, although the system according to embodiments of the invention primarily intends to improve the user-friendliness when playing back sound or audio data, it is also possible to apply the system for a combination of audio data and visual data. For instance, an embodiment of the invention may be implemented in audiovisual applications like a video player in which a loudspeaker is used, or a home cinema system.

The device may comprise an audio reproduction unit such as a loudspeaker. The communication between audio processing components of the audio device and such a reproduction unit may be carried out in a wired manner (for instance using a cable) or in a wireless manner (for instance via a WLAN, infrared communication or Bluetooth).

Because arrays of limited width have poor capabilities to change their directivity, it may be advantageous to the limit the bass-range of the audio with a high-pass filter. This may be in either of the program channels, or user channels. This optional feature is of course not necessary if there is only one listener, so this feature might be switchable.

The aspects defined above and further aspects of the invention are apparent from the examples of embodiment to be described hereinafter and are explained with reference to these examples of embodiment.

BRIEF DESCRIPTION OF THE DRAWINGS

The invention will be described in more detail hereinafter with reference to examples of embodiment but to which the invention is not limited.

DESCRIPTION OF EMBODIMENTS

Figure 1:
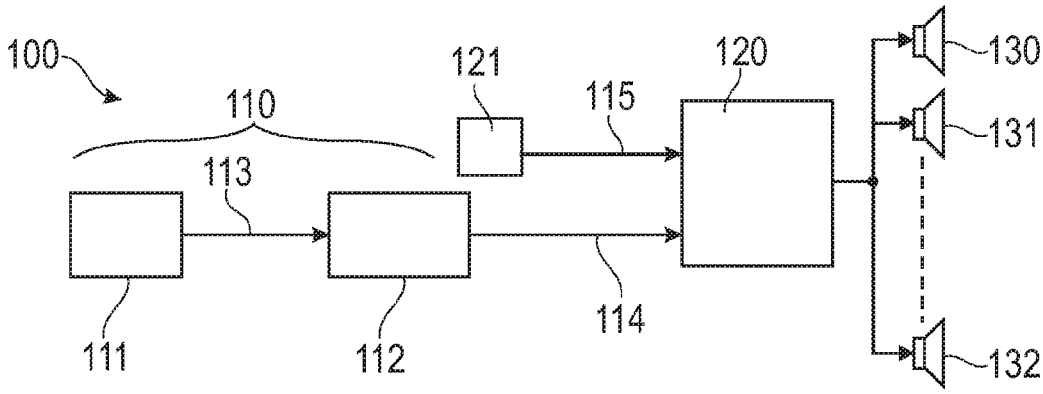
FIG. 1 shows an audio processing device according to an exemplary embodiment of the invention.

The illustration in the drawing is schematically. In different drawings, similar or identical elements are provided with the same reference signs.

In the following, referring to FIG. 1, an audio data processing device 100 according to an exemplary embodiment of the invention will be explained.

The audio data processing device 100 comprises a detection unit 110 for detecting individual audio reproduction modes indicative of a personalized way of reproducing the audio data separately for each of a plurality of human listeners.

Furthermore, a microprocessor or processing unit 120 is provided for processing the audio data to thereby generate reproducible, audible audio data separately for each of the plurality of human users in accordance with the detected individual reproduction modes.

In more detail, each of a plurality of human listeners (not shown in FIG. 1) is equipped with an individual remote control unit. With the remote control unit of the respective user, this user may adjust the audio playback properties. In case the user is presently reading a book, this user may select the audio to be played back in her or his direction with relatively low amplitude so that the background audio is not disturbing for this user. Another user may have hearing problems and may thus wish to adjust the desired audio intensity at her or his position to be relatively high.

Moreover, each of the remote control units of the users may be provided with a microphone or any other transponder so that a direction/position of the corresponding remote control and thus of the corresponding user may be detected automatically by an exchange of distance measurement signals between the microphone and a communication interface of the corresponding control unit 120 of the audio data processing device 100.

Thus, the user-defined operation mode parameters input via the remote controls in combination with the detected positions/directions may allow a level and direction selection unit 111 to determine proper level and corresponding direction information 113 to a target response construction unit 112. The target response construction unit 112 generates, based on the level and corresponding direction information 113, a target response signal 114 which is input as an audio reproduction control signal to the signal processor 120.

Furthermore, audio content stored in an audio source 121 (for instance a hard disk, a CD, a DVD or a remote audio source like a radio station) provides audio input signals 115 to another input of the signal processor 120. The signal processor 120 processes the audio input signal in 115 in accordance with the target response signal 114 and generates audio output signals which is supplied to a plurality of loudspeakers 130 to 132 forming a spatially distributed loudspeaker array.

This spatial arrangement of the loudspeakers 130 to 132 in combination with the audio playback parameters supplied to these loudspeakers 130 to 132 in addition results in a spatial distribution of emitted audio signals of the loudspeakers 130 to 132 which generates "superimposed" audio waves in a specific manner so as to result in an audio reproduction in accordance with the desired audio parameters input by the users and/or detected by the direction detector 111. Consequently, a plurality of users can simultaneously enjoy the same audio content to be played back in accordance with user-specific playback parameters.

The loudspeakers 130 to 132 may be directive loudspeakers. Via the respective remote control unit, the user-specific audio data reproduction loudness and equalization parameters, that is to say intensity and frequency distribution may be selected.

The reproducible data generated by the signal processor 120 and played back via the loudspeakers 130 to 132 may take into account the detected position of the respective user, a detected direction, a detected present activity of the user and user-specific properties (like hearing problems, etc.).

Thus, FIG. 1 illustrates a basic scheme of an embodiment of the invention. The individual blocks will be discussed in more detail in the following description of the first embodiment below. Two other embodiments differ from the first embodiment mainly in the way the information about the desired levels and the corresponding directions are obtained (that is to say the function of the level and direction selection block 111).

In the first embodiment shown in FIG. 1, individual listeners have individual remote controls, with which they can select their own preferred sound level. To be able to render the selected sound levels in the desired directions, the direction of each remote control, relative to the rendering system 100, should be known. The direction of a remote control can be determined, for instance, by integrating a microphone unit in the remote control units, and utilizing the acoustical travel-time differences between the remote control and each (or several) of the loudspeakers 130 to 132 of the rendering system 100. In the embodiment shown in FIG. 1, the remote controls (including the means to determine their directions) constitute the level and direction selection block 111 in FIG. 1.

The selected levels and the corresponding directions are translated into a target response function in the target response construction block 112 of FIG. 1, which, depending on the details of the rendering technique, may comprise a specification of the desired level only in the direction of the respective listeners or may comprise a more or less continuous specification of the desired level as a function of the angle.

Figure 4:
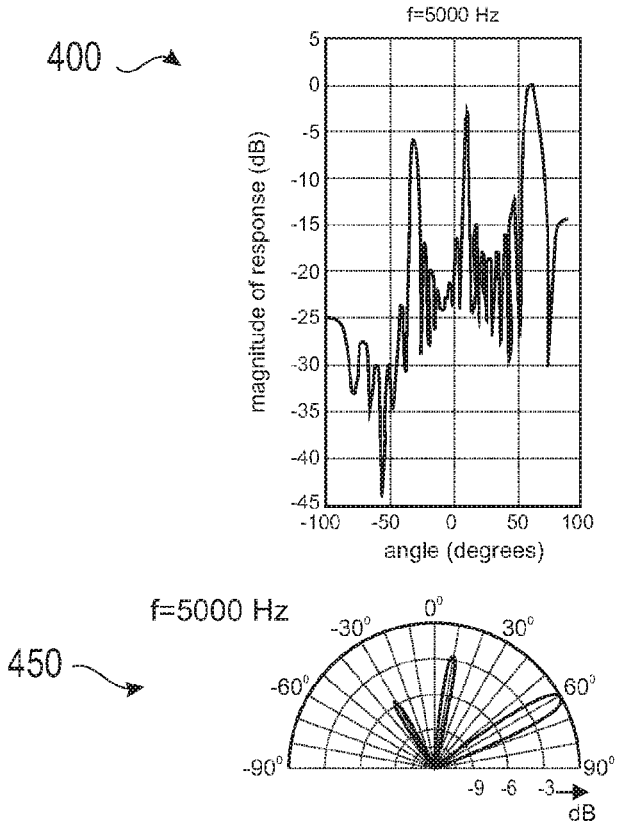
FIG. 4 shows results of a simulation of a directed emission of three audio beams according to an exemplary embodiment of the invention.
Figure 6:
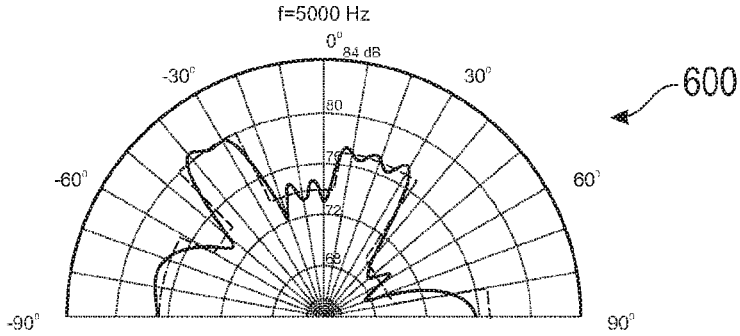
FIG. 6 shows results of a simulation of a continuous acoustical directivity pattern according to an exemplary embodiment of the invention.
Figure 7:
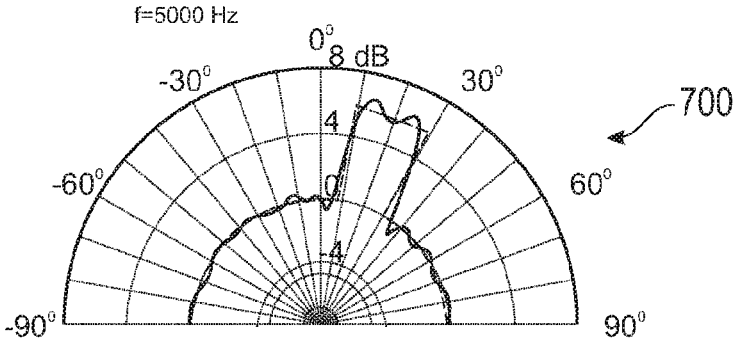
FIG. 7 shows results of a simulation of a continuous acoustical directivity pattern according to an exemplary embodiment of the invention.
Figure 8:
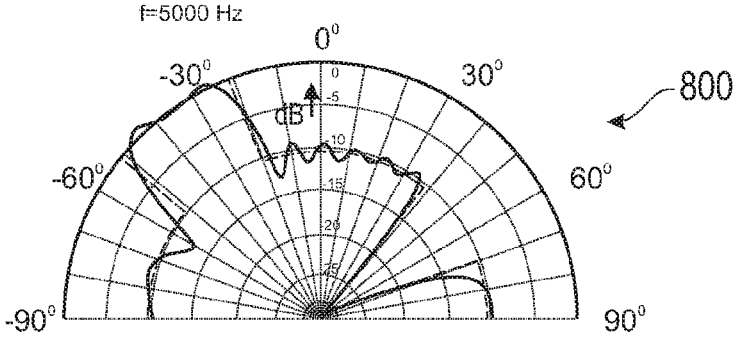
FIG. 8 shows results of a simulation of a directed emission of audio beams according to an exemplary embodiment of the invention.

An example of the former way of specifying the target response is shown in a block 450 of FIG. 4, showing the target response for a situation with three listeners in directions −30°, +10° and +60°, having selected levels of −6 dB, −3 dB and 0 dB, respectively. Examples of the latter way of specifying the target function are shown in FIG. 6 to FIG. 8. The desired level of an individual listener may be zero, meaning that no sound is rendered in her or his direction. An example of a target response that includes such a null direction is shown in FIG. 8.

The signal processor 120 then takes the audio input signal 115 and the target response specification 114 and calculates the audio signals for the loudspeakers 130 to 132 such that the resulting total sound field has a directional response corresponding to the target response 114. Two signal processing techniques for achieving a given target response using a linear array of loudspeakers are discussed below.

The described first embodiment allows for high flexibility in setting and changing a personal sound level.

In the following, a second embodiment will be explained.

In the second embodiment, one or more cameras are used to detect and track the positions of the individual listeners, and visual recognition software is used to identify the individual listeners from a set of known persons. For each of these known persons, a personal profile has been stored that contains that person's level preference (which may depend on variables such as the type of content). A target response is constructed according to the visually extracted directions of the individual listeners and the corresponding stored level preferences. The target response construction block 112 and the signal processor block 120 of FIG. 1 can be the same as described for the first embodiment.

The second embodiment is particularly useful for automatically incorporating general (non-instaneous) individual level preferences in the normal operation of the sound reproduction system.

In the following, a third embodiment will be explained.

In this third embodiment, the direction of a single listener is identified by means of a tag, worn by or attached to the person, and the level of the sound is adapted in that person's direction according to a stored profile. This tag could for example be used to indicate the location of a person with the hearing impairment, in which case the stored profile would indicate that the level should be increased by a certain amount in the corresponding direction.

The resulting target response could look as shown in FIG. 7, in which the level is raised 6 dB in a small region around +20° relative to the level in all other directions. Another application of the third embodiment can be that the tag is worn by a person who wants to receive as little sound as possible, for instance because he or she is reading a book. In that case, the stored profile would indicate that the level should be as low as possible in the corresponding direction.

In the following, array processing methods for achieving a given target response will be explained.

The described methods may enable generating a sound field with a spatial response that matches a given target response with an array of loudspeakers.

In a first method, the sound level can be controlled in a discrete number of selected directions, while the sound level is uncontrolled, but relatively low, in all other directions. This is done by sending an individual beam of sound in each of the selected directions by using the principle of delay and sum beam-forming, and scaling the amplitude of each beam according to the desired sound level for the corresponding direction.

Figure 2:
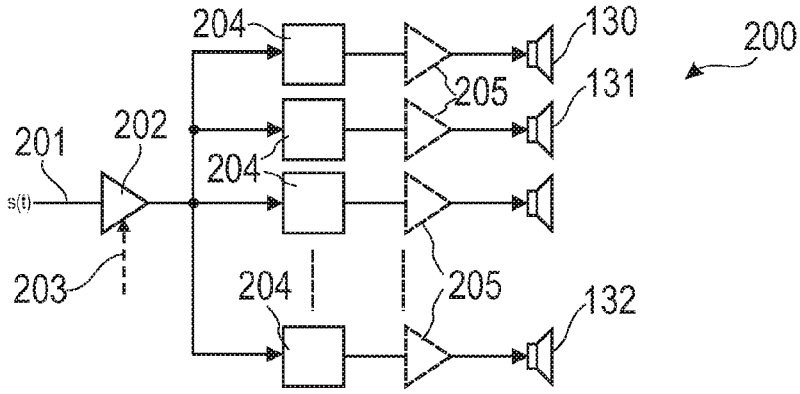
FIG. 2 shows a data processing scheme according to an exemplary embodiment of the invention.

FIG. 2 shows a delay and sum processing system 200 for generating a beam with controlled level in one direction.

Thus, FIG. 2 shows in detail how a beam with a control sound level is generated in one particular direction with an array of N loudspeakers 130 to 132.

First, an input signal s(t) 201 is amplified or attenuated by multiplying it with a scaling factor g of an amplifier unit 202. The scaling factor g of the amplifying unit 202 is determined by a desired sound level for this direction, signal 203, relative to some reference level. Then, the scaled version of the input signal s(t) is replicated N times, and each of the N replicas is delayed using an individual delay unit 204. The delay value of the delay unit 204 is determined by the position of the corresponding loudspeakers 130 to 132 and the direction to which the beam is to be steered. The delay value of each of the delay units 204 may be different. Finally, the N delayed signals are fed to the corresponding loudspeakers 130 to 132, and an acoustic beam having the desired level (relative to the reference level) is generated in the desired direction. Optionally, gain units 205 may be provided. The gain value of each of the gain units 205 may be different.

Since the described processing scheme is linear, beams in M individual directions with individual levels can be reproduced simultaneously by applying the signal processing scheme of FIG. 2 for each individual direction and summing all the signals that correspond to the same loudspeaker 130 to 132, after which each summed signal is connected to the corresponding loudspeaker 130 to 132.

Figure 3:
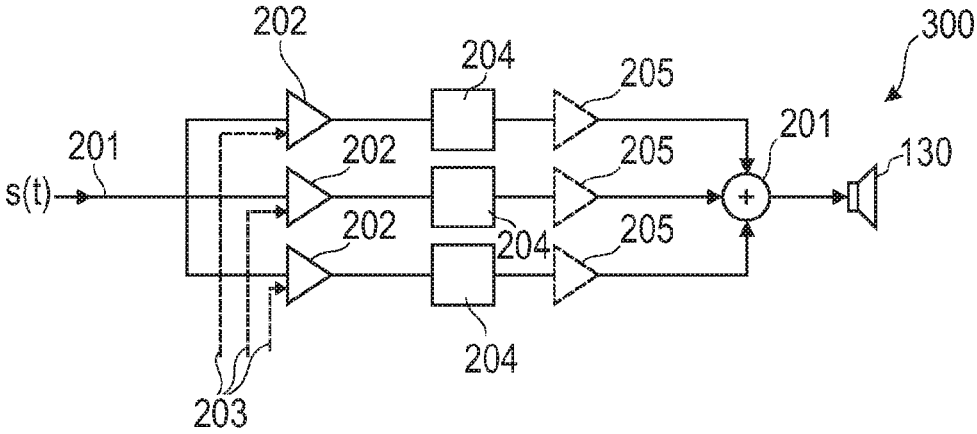
FIG. 3 shows a data processing scheme according to an exemplary embodiment of the invention.

FIG. 3 illustrates a scheme 300 for a loudspeaker 130 for a case with three directions with individually controlled sound level.

In the scenario of FIG. 3, desired sound levels for the three directions are provided as three input signals 203 which are supplied to control three gain units 202. Furthermore, three delay units 204 are provided, and three optional gain units 205. The output signals of the delay units 204 or of the gain units 205, respectively, are summed in a summing unit 301 and are then supplied to the loudspeaker 130.

Therefore, FIG. 3 shows the processing scheme 300 for a loudspeaker 130 for a case in which three beams in individual directions with individual levels are generated. The part before the delay units 204 may be common for all loudspeakers 130 to 132.

FIG. 4 shows diagrams illustrating a level versus angle plot 400 and a polar plot 450 of the simulated response of a case in which three beams are generated in directions −30°, +10° and +60° with controlled levels of −6 dB, −3 dB and 0 dB, respectively.

In a variation of this method, the relative sound level is not controlled in a discrete number of selected directions, but at a discrete number of selected positions. The processing scheme of FIG. 2 and FIG. 3 essentially remains the same, only the calculation of the delays 204 is slightly different.

However, it may happen, when applying this first method, that when generating each individual beam, only the sound level in the corresponding direction is controlled. In general, but especially when the number of loudspeakers 130 to 132 and/or the total length of the array are small, sound will also be radiated into other directions. First of all, the so-called main lobe (the beam in the selected direction) has a certain width, which, for a given array configuration, increases for decreasing frequency. Furthermore, because of the finite length and number of speakers 130 to 132 in the array, artefacts may be generated in the form of so-called side and grating lobes. This means that when the sound fields of the individual beams are added together, the actual level in each of the desired directions will be influenced by the simultaneous reproduction of the other beams, in an uncontrolled way. Partly, this problem can be reduced by adding carefully chosen individual amplitude weights into the signal path of each combination of beam and loudspeaker 130 to 132 (they are shown as optional in FIG. 2 and FIG. 3) and/or slightly adjusting the values of the delays 204. A person skilled in the art knows many such techniques from literature.

However, the larger the number of directions for which it is desired to individually control the sound level, the more likely it becomes that the individual beams interfere with one another, and it may be therefore not possible in this first embodiment to realize an arbitrary level versus angle characteristic, that is to say a response that is controlled in every direction, as opposed to choosing a discrete number of isolated target directions.

An advantage of this first method is that the signal processing involved is very simple: Only a delay and gain for each combination of selected direction and loudspeaker (a total of M×N) are required, while the calculation of the delays and gains is straightforward and easy to implement in a real time application.

In the following, a second method will be explained.

This second method in principle enables the realization of an arbitrary sound level versus direction function, that is to say the sound level can be controlled in all possible directions at the same time.

In this embodiment, first a target response function T is defined, which is a specification of the desired sound level as a function of angle, for a large number of angles M.

An arbitrary sample of a target response is shown in the scheme 600 of FIG. 6.

This target response may be chosen to be different for different frequencies. However, in the present application of "personal volume", the aim is usually to have a direction response that is essentially frequency independent, so that at all listening positions the frequency response is flat and only the broadband sound pressure level varies as a function of listening position.

The target response T can be realized (or at least approximated) by calculating the loudspeaker driving functions not in an analytical, geometrical way as in the delay and sum method of the first embodiment, but by using a numerical optimization procedure (as described in, for example, NatLab Techn. Note 2000/002, NatLab Techn. Note 2001/355, excerpts of which being available as items 48 and 22 via http://www.extra.research.philips.com/hera/people/aarts/, and van Beuningen and Start, "Optimizing directivity properties of DSP controlled loudspeaker arrays", Duran Audio, 2000, for instance available via http://dctrl.fib.unam.mx/~villabpe/line%20arrays/IOA_paper_rev1p2.pdf).

In this approach, for each individual frequency, an (M×N) matrix G(ω) is composed that describes the sound propagation from each individual loudspeaker in each individual direction at this frequency ω. The total response of the array system in all M target directions, resulting from a set of N complex loudspeaker coefficients H(ω), can now be written in a matrix equation as:

$$L(\omega)=G(\omega)H(\omega).$$

The goal is to determine the set of loudspeaker coefficients H(ω) that results in a response function L(ω) that is as close as possible to the target response function T. In other words: To determine the set H(ω) that minimizes the length of the vector L(ω)−T. This means that it is necessary to find a solution to the following minimization problem:

$$\min_{H(\omega)}(\|G(\omega)H(\omega)-T\|).$$

There are many algorithms available in literature to solve this minimization problem, for instance a large variety of so-called least square algorithms. In general, it is necessary to put certain constraints on the loudspeaker coefficients that are allowed, in order to obtain solutions that are acceptable from an efficiency and stability point of view. This means that so-called constrained optimization algorithms may be used, for example the MATLAB function lsqlin (see "MATLAB Optimization Toolbox User's Guide"). This also gives more freedom in specifying the target response: At each angle, besides the possibility to specify a specific desired level, it is now also possible to instead make the response meet some looser condition (for example: it should not exceed a certain maximum level). This leaves more degrees of freedom to the optimization problem, which may result in a more satisfactory solution.

Solving the above-mentioned minimization problem equation for a number of individual frequencies results in a complex frequency response for each loudspeaker 130 to 132, from which the N individual loudspeaker driving signals can be calculated (for instance by an inverse Fourier transform). These driving signals can be implemented as FIR (finite impulse response) filters, meaning that compared to the processing scheme of the first method, all processing shown in FIG. 3 for a single loudspeaker 130 to 132 is then replaced by a single FIR filter, so that a total processing scheme consists of a number N of FIR filters, as shown in the data processing system 500 of FIG. 5.

Figure 5:
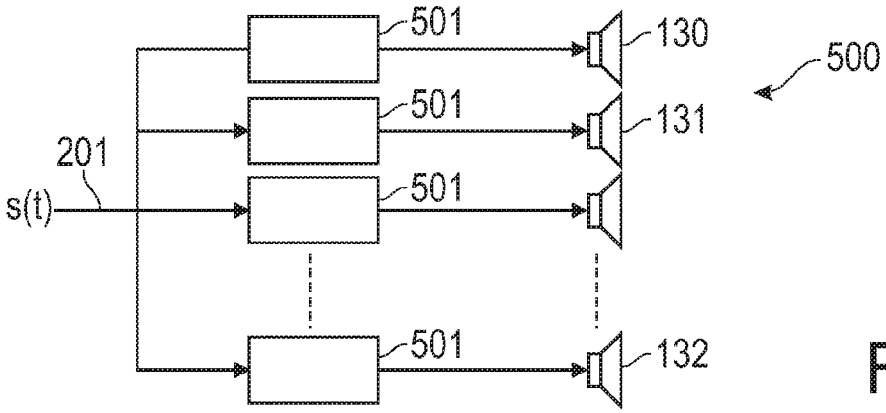
FIG. 5 shows a data processing scheme according to an exemplary embodiment of the invention.

Thus, FIG. 5 shows a total processing scheme 500 for the second described processing method.

The signal s(t) 201 is supplied to each of a plurality of FIR filters 501 which are connected in parallel to one another. The output of each of the FIR filters 501 is connected to a respective one of the loudspeakers 130 to 132 for playback. The filter characteristic of each of the FIR filters 501 may be different.

FIG. 6 shows a polar plot 600 indicating the result of applying the second method to realize a target response function, using an array of 24 loudspeakers of total length 0.74 m and 256 taps for the FIR filters 501. It is seen in FIG. 6 that the match is very good, and this example shows the versatility of this method in realizing a wide variety of directional responses.

FIG. 7 shows a diagram 700 and FIG. 8 shows a diagram 800 both illustrating examples of results for two other interesting target response functions, which correspond to two of the user situations.

FIG. 7 shows a response that might be suitable for the situation in which several people are watching the same TV show, with one of them having a hearing problem, so that he or she prefers a somewhat louder level. For this situation, a response function is desired which has an essentially even sound level of 0 dB for all directions, except for the region in which the hearing impaired listener is sitting, in which the level is raised by 6 dB.

FIG. 8 shows the situation in which one person is watching TV, while another person is reading a book and does not want to be disturbed by a loud TV sound. A response function is designed with a maximum sound level in the region of the person watching TV, and the sound level is as low as possible in the region around the person reading a book, while the level is kept low (−10 dB) elsewhere.

How well a given desired target response can be realized with a given loudspeaker array depends on various properties of that array. For instance, the lowest frequency for which a certain spatial resolution in the array response (that is to say the smallest angle over which the variation response can be controlled) can be realized, is determined by the total length of the array, while the highest frequency for which the directional response can be controlled without the occurrence of spatial under sampling artefacts is determined by the spacing between the loudspeakers 130 to 132. Furthermore, the maximum spatial resolution that can be obtained is limited by the total number of loudspeakers 130 to 132 in the array.

In the following, referring to FIG. 9, a data processing device 900 according to an exemplary embodiment of the invention will be explained.

The data processing device 900 has a first input 901 at which a first audio data signal is provided. Furthermore, the device 900 has a second audio input 902 at which a second audio data signal, which differs from the first audio data signal, is provided. A detection unit (not shown in FIG. 9) may be provided for detecting individual reproduction modes indicative of a way of reproducing the first audio data 901 and the second audio data 902, respectively, separately for each of a plurality of human users.

For instance, a first listener (not shown) desires to hear the first audio item 901. A second user desires to listen to the second audio item 902. The first user does not want to be disturbed by audio signals from the second audio item 902. The second user does not want to be disturbed by audio signals from the first audio item 901. Thus, the users sitting at different positions within, for instance, a living room, may adjust via remote controls the audio content they desire to listen to. This desired reproduction mode for the two users may be detected by the system 900, and a data processor 903 may be adjusted in such a manner that it processes the data 901, 902 to thereby generate reproducible data 904, 905, that is to say two different sound beams 904, 905 propagating into different directions.

In other words, a first sound beam 904 is generated and emitted in direction of the first user, and is indicative of the first audio data item 901. A second sound beam 905 is emitted in another direction towards the second user and is indicative of the second audio item 902. The sound beams 904, 905 are generated by a plurality of loudspeakers 130 to 132 which are controlled by an output of the array processor 903.

Figure 9:
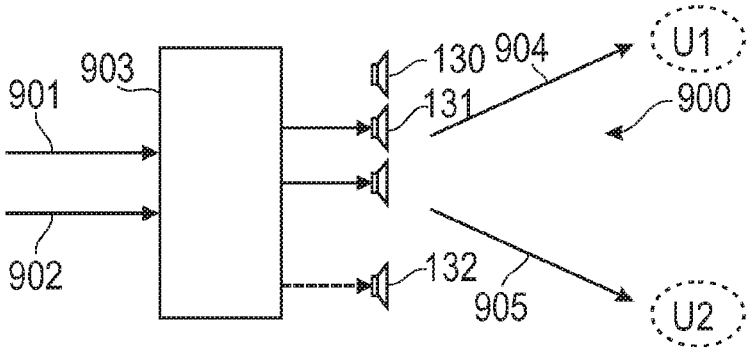
FIG. 9 shows an audio processing device according to an exemplary embodiment of the invention.

The number of loudspeakers 130 to 132 in FIG. 9 is denoted as $N_{out}$.

In the embodiment of FIG. 9, the processing unit 903 is therefore adapted to generate reproducible data 904, 905 separately for each of the plurality of human users based on the data 901, 902 which differ for the two human users.

As will be described below in more detail, the processing unit 903 is adapted to generate the reproducible data implementing an Automatic Level Control (ALC) function.

With the advent of loudspeaker arrays and five channel sound reproduction capabilities on FlatTV and home cinema receiver systems, personal sound becomes relevant.

In FIG. 9, the basic operation of the array processor 903 for personal sound application is shown. The array processor 903 takes the two input audio channels 901, 902, which are to be sent to individual directions, and derives $N_{out}$ output audio channels, which are connected to the $N_{out}$ loudspeaker units 130 to 132. In the general case, both input signals 901, 902 of the array processor 903 contribute to each of the $N_{out}$ output signals. Each of the $N_{out}$ output signals is formed by summation of the individual contributions of both input channels 901, 902. When the $N_{out}$ output signals are amplified and connected to the loudspeaker array 130 to 132, two individual sound beams 904, 905 are generated, sending the sound of each input channel 901, 902 to an individual direction. The direction of each beam 904, 905 is determined by the way in which the corresponding input channel contributes to each of the $N_{out}$ loudspeaker signals. In each of the two individual directions, a listener is located who wants to listen to the sound of the corresponding input audio channel 901, 902, while hearing as little sound from the other channel 902, 901 as possible.

When the signal levels of both input channels 901, 902 of the array processor 903 are equal, for each of the two chosen listening directions a measurement or simulation can be done to determine the difference between the Sound Pressure Level (SPL) for the channel that corresponds to that direction (desired channel) and the SPL in the same direction of the other channel (undesired channel), as generated by the loudspeaker array 130 to 132. The level difference depends among others on the configuration of the loudspeaker array 130 to 132, the way in which each input channel contributes to each of the output channels (as controlled by the array processor 903), the chosen directions of the beams and the frequency.

Research has shown that typically an SPL difference between the desired and undesired channel of at least 11 dB is required for a comfortable listening experience without annoying crosstalk from the undesired channel.

Figure 10:
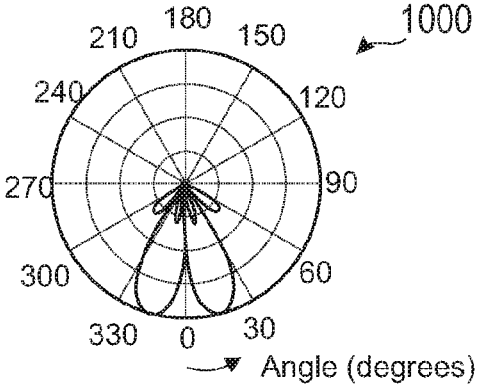
FIG. 10 shows results of a simulation of a directed emission of two audio beams according to an exemplary embodiment of the invention.

Given the physical limitation of the array with respect to the number of drivers and the total array length that can be afforded/fit in a product such as a FlatTV, it is typically possible to obtain a channel separation of about 15 dB for two seats spaced about 30° apart, relative to the centre of the array, which suffices if the two channels are equally loud (see scheme 1000 of FIG. 10).

The polar plot 1000 of FIG. 10 is a directivity plot of a 6-driver loudspeaker array sending sound beams in directions of +15° and −15°.

Figure 11:
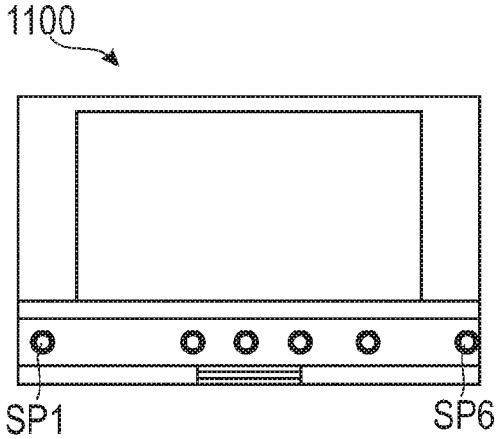
FIG. 11 shows a 6-driver loudspeaker array according to an exemplary embodiment of the invention.

FIG. 11 illustrates a 6-driver loudspeaker array 1100 (total length 0.5 m).

In practice, the levels of the input signals of the system are in general not equal, as they correspond, for instance, to different TV channels, different types of program material (speech and music), or outputs from different audio devices. Now, the actual SPL difference between the two channels measured in any direction, is the sum of the SPL difference that would be obtained with equal input levels and the (signed) input level difference of the two channels. This can result in the fact that although the performance of the array itself is sufficient to achieve a separation of more than the required 11 dB between the SPLs of the two channels, the actual separation that is achieved as less than 11 dB in the direction of the sound beam of the channel with the lower input level, so the perceived performance becomes unsatisfactory. This happens when the input level difference exceeds the "Performance Headroom" of the array, defined as:

$$\text{Performance Headroom} = \Delta L_{eq} - 11\ \text{dB}(\text{for } \Delta L_{eq} > 11\ \text{dB}),$$

in which $\Delta L_{eq}$ is the SPL difference that is achieved with equal input levels. In the direction of the beam of the louder channel, the achieved separation actually exceeds $\Delta L_{eq}$ by an amount equal to the input level difference.

According to an exemplary embodiment of the invention, Automatic Level Control (ALC) is used in conjunction with the personal sound array to guarantee a 11 dB channel separation at all times and for all configurations. An exemplary embodiment of the invention is required to make arrays work in this application because of the physical limitations of the array.

Figure 12:
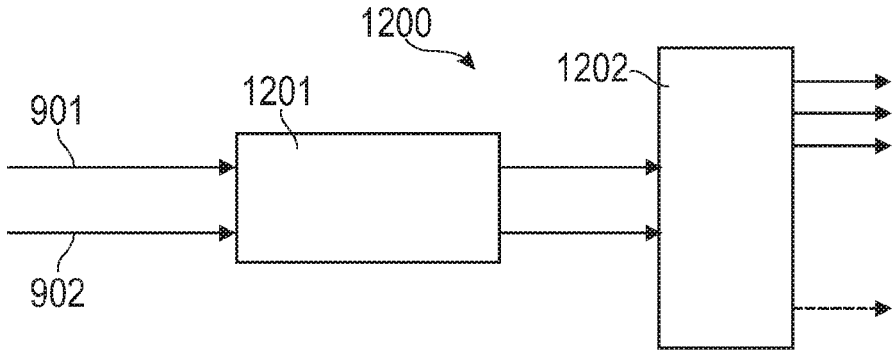
FIG. 12 shows an audio processing device according to an exemplary embodiment of the invention.

According to an exemplary embodiment of the invention, the complete array processing system is provided comprising two basic parts (see data processing system 1200 of FIG. 12): an Automatic Level Control unit (ALC) 1201 and an array processor unit 1202 providing outputs which are driving signals for the individual array loudspeakers 130 to 132 (see FIG. 9).

The array processor 1202 works as described above. It takes two input audio channels 901, 902, which are to be sent to individual directions, and derives $N_{out}$ output audio channels (the actual input channels to the array processor 1202 are not the input audio channels 901, 902, but the input audio channels 901, 902 after modification by the ALC unit 1201). The $N_{out}$ output signals are amplified and connected to the loudspeaker array 130 to 132, such that two individual "sound beams" 904, 905 are generated, sending the sound of each input channel to an individual direction.

For the reasons described above, it should be avoided that the input level difference of the two channels exceeds the Performance Headroom. This is the task of the Automatic Level Control unit 1201 that precedes the array processor unit 1202.

The input signals 901, 902 of the system 1200 are first fed to the ALC unit 1201.

Figure 13:
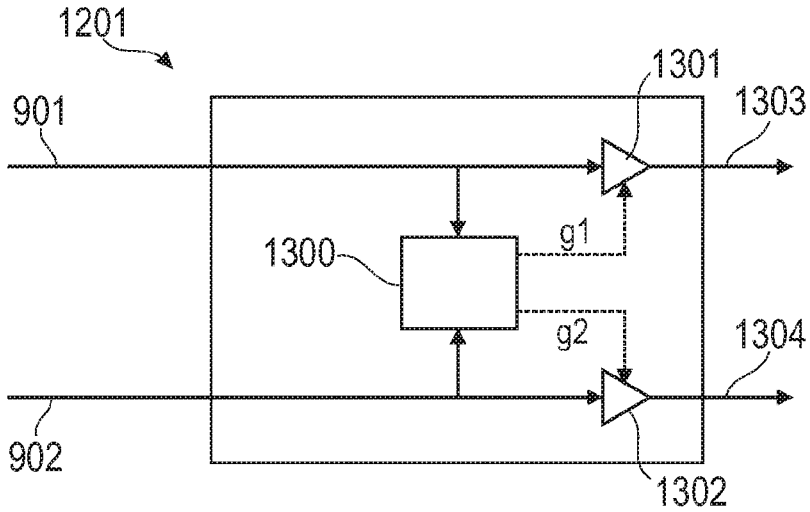
FIG. 13 shows an Automatic Level Control system according to an exemplary embodiment of the invention.

An exemplary embodiment of the ALC unit 1201 is shown in more detail in FIG. 13.

The ALC unit 1201 contains a level comparator circuit 1300 which analyses the input levels of both input signals 901, 902 over a short time interval and determines whether the input level difference exceeds the Performance Headroom, based on known Performance Headroom data from simulations or measurements. If the input level difference indeed exceeds the Performance Headroom, the ALC unit 1300 applies individual gains g1 and g2 to each input signal 901, 902, such that the level difference is reduced to a value smaller than the Performance Headroom. These signals 1303, 1304 with reduced level difference generated by the gain units 1301, 1302 are the output of the ALC unit 1201 and are fed to the inputs of the array processor unit 1202 (see FIG. 12), which functions as described above. This way, it is guaranteed that the resulting SPL difference in the two target directions will be larger than 11 dB (provided the SPL difference with equal input levels is larger than 11 dB).

Typically, the input level difference of the two channels as a function of time is a superposition of a relatively slow varying difference of the average levels and a relatively fast varying variation of each signal level around its slow varying average level. Perceptually, it might be advantageous to first reduce the dynamic range of each individual input signal by means of a compressor circuit with a short time constant, before comparing the two signal levels in the level comparator unit 1300, which has a larger time constant.

Figure 14:
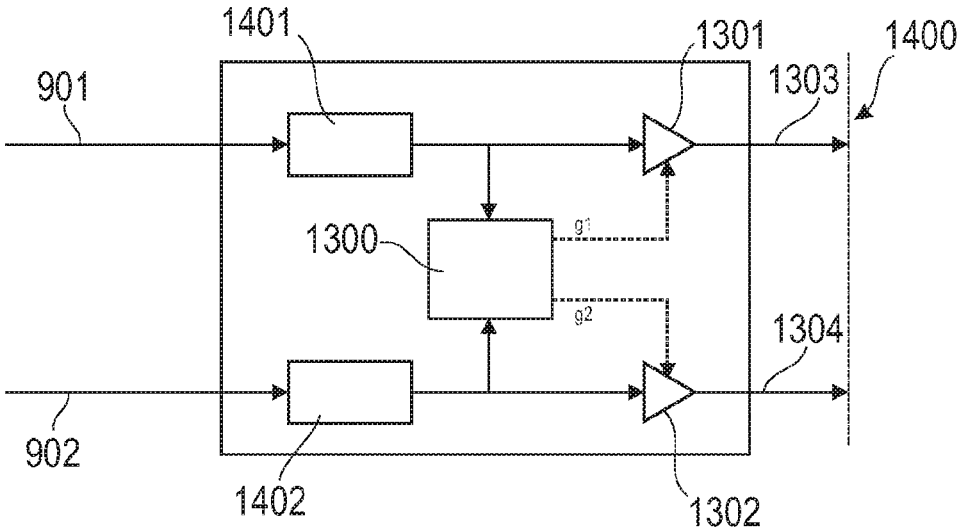
FIG. 14 shows an Automatic Level Control system according to an exemplary embodiment of the invention.

Such a situation is shown in FIG. 14 illustrating an ALC unit 1400 with compressor 1401, 1402.

This way, the risk of the occurrence of "pumping" artefacts will be reduced. Therefore, in an exemplary embodiment, the ALC unit 1400 contains an individual compressor 1401, 1402 for each input channel 901, 902, which reduces the dynamic range of the input signals 901, 902 before it is sent to the level comparator circuit 1300.

In an exemplary embodiment, the directions to which the individual sound beams 904, 905 are sent are user-controllable.

In an exemplary embodiment, the amount of level difference reduction between the two input channels 901, 902 is user-controllable, in order to allow the user to make a trade-off, based on personal preference, between the amount of separation between the desired and undesired channel that is achieved and preserving the original dynamics of the input signals.

The value of 11 dB for the required separation between the two channels 901, 902 is an average for different kinds of content. Since the amount of separation that is needed between the two channels 901, 902 depends also on the type of program material of the two channels 901, 902, in a preferred embodiment the amount of reduction of the input level difference is controlled by automatic content classification.

For some combinations of types of content, this means that it might be actually advantageous to increase, rather than reduce, the level difference between the input signals. For instance, it may be supposed that comfortably listening to speech (that is to say being able to understand the speech) requires more separation than listening to music. This means that when one channel contains music and the other one contains speech which are at the same level, it might be advantageous to increase the level of the speech.

Since both the level difference of the input signals and the SPL difference generated by the array are in general frequency dependent, according to an exemplary embodiment, the ALC works in frequency bands.

It should be noted that the term "comprising" does not exclude other elements or features and the "a" or "an" does not exclude a plurality. Also elements described in association with different embodiments may be combined.

It should also be noted that reference signs in the claims shall not be construed as limiting the scope of the claims.

The invention claimed is:

1. A device for processing data, the device comprising a detection unit adapted for detecting individual reproduction modes indicative of a manner of reproducing the data for each of a plurality of users;

a processing unit adapted for:

processing the data to generate reproducible data for each of the plurality of users, determining a direction for each of the plurality of users;

transmitting said reproducible data to corresponding ones of said users in a direction determined for said corresponding ones of said users, wherein said reproducible data transmitted to said corresponding ones of said users is adjusted according to said individual reproduction modes associated with said corresponding ones of said users.

2. The device according to claim 1, further comprising:

a reproduction unit adapted for reproducing the generated reproducible data in a separate manner for each of the plurality of users.

3. The device according to claim 2, wherein the reproduction unit is adapted for reproducing the generated reproducible data in at least one of the group consisting of a spatially selective manner, a spatially differentiated manner, and a spatially directive manner.

4. The device according to claim 2, wherein the reproduction unit comprises a spatial arrangement of a plurality of loudspeakers for reproducing audible data as the reproducible data.

5. The device according to claim 1, adapted for processing data comprising at least one of the group consisting of audio data, video data, image data, and media data.

6. The device according to claim 1, wherein the detection unit comprises a plurality of remote control units, each of the plurality of remote control units being assigned to a respective one of the plurality of users and being adapted for detecting a respective one of the individual reproduction modes.

7. The device according to claim 2, wherein the detection unit comprises a distance measuring unit adapted for measuring the distance between the reproduction unit and each of the plurality of users.

8. The device according to claim 2, wherein the detection unit comprises a direction measuring unit adapted for measuring a direction between the reproduction unit and each of the plurality of users.

9. The device according to claim 1, wherein the detection unit comprises an image recognition unit adapted for acquiring an image of each of the plurality of users and adapted for recognizing each of the plurality of users, thereby providing information for detecting the individual reproduction modes.

10. The device according to claim 1, wherein the detection unit comprises a plurality of, particularly wirelessly operating, identification units, each of the plurality of identification units being assigned to a respective one of the plurality of users and being adapted for providing information for detecting a respective one of the individual reproduction modes.

11. The device according to claim 1, wherein each of the individual reproduction modes is indicative of at least one of the group consisting of a data reproduction intensity, an audio data reproduction loudness, an audio data reproduction equalization, an image data reproduction brightness, an image data reproduction contrast, an image data reproduction color, and a data reproduction trick-play mode.

12. The device according to claim 1, wherein the processing unit is adapted to generate the reproducible data in accordance with at least one of the group consisting of a detected position, a detected direction, a detected activity, and a detected personal property of a respective one of the plurality of users.

13. The device according to claim 1, wherein the processing unit is adapted to generate the reproducible data in accordance with an audio data level-versus user direction characteristic derived from the detected individual reproduction modes.

14. The device according to claim 1, wherein the processing unit is adapted to generate reproducible data separately for each of the plurality of users with regard to data which differs for different ones of the plurality of users.

15. The device according to claim 13, wherein the processing unit is adapted to generate the reproducible data implementing an Automatic Level Control for controlling a level difference with regard to the data which differs for different ones of the plurality of users.

16. The device according to claim 15, wherein the Automatic Level Control is adapted for controlling the level difference in two stages with different time parameters.

17. The device according to claim 15, wherein the Automatic Level Control is adapted for controlling the level difference in dependence of an automatic content classification of the data which differs for different ones of the plurality of users.

18. The device according to claim 14, wherein the processing unit is adapted to generate the reproducible data implementing an Automatic Level Control in such a manner to guarantee an intensity separation for different ones of the plurality of users of at least a predetermined threshold value.

19. The device according to claim 18, wherein the data is audio data, and wherein the predetermined threshold value is essentially 11 dB.

20. The device according to claim 18, wherein the predetermined threshold value is user-controllable.

21. The device according to claim 15, wherein the processing unit is adapted to generate the reproducible data implementing a frequency-dependent Automatic Level Control.

22. The device according to claim 1, realized as at least one of a group consisting of:

a television device, a video recorder, a monitor, a gaming device, a laptop, an audio player, a DVD player, a CD player, a hard disk-based media player, an internet radio device, a public entertainment device, an MP3 player, a hi-fi system, a vehicle entertainment device, a car entertainment device, a medical communication system, a body-worn device, a speech communication device, a home cinema system, and a music hall system.

23. A method of processing data, the method comprising:

detecting individual reproduction modes indicative of a manner of reproducing the data;

processing the data to generate reproducible data for each of the plurality of users;

determining a direction for each of the plurality of users;

transmitting said reproducible data to corresponding ones of said users in a direction determined for said corresponding ones of said users, wherein said reproducible data transmitted to said corresponding ones of said users is adjusted according to said individual reproduction modes associated with said corresponding ones of said users.

24. A program element, which, when being executed by a processor, is adapted to control or carry out a method of processing data, the method comprising:

detecting individual reproduction modes indicative of a manner of reproducing the data for each of a plurality-users;

processing the data to generate reproducible data for each of the plurality of users, determining a direction for each of the plurality of users;

transmitting said reproducible data to corresponding ones of said users in a direction determined for said corresponding ones of said users, adjusting each of said reproducible data transmitted to said corresponding ones of said users according to said individual reproduction modes associated with said corresponding ones of said users.

25. A computer-readable non-transitory medium, in which a computer program is stored, which, when being executed by a processor, is adapted to control or carry out a method of processing data, the method comprising:

detecting individual reproduction modes indicative of a manner of reproducing the data for each of a plurality of users;

processing the data to generate reproducible data for each of the plurality of users;

determining a direction for each of the plurality of users;

transmitting said reproducible data to corresponding ones of said users in a direction determined for said corresponding ones of said users, wherein said reproducible data transmitted to said corresponding ones of said users is adjusted according to said individual reproduction modes associated with said corresponding ones of said users.

* * * * *